US006258246B1

(12) United States Patent
Duruz et al.

(10) Patent No.: US 6,258,246 B1
(45) Date of Patent: Jul. 10, 2001

(54) ALUMINIUM ELECTROWINNING CELL WITH SIDEWALLS RESISTANT TO MOLTEN ELECTROLYTE

(75) Inventors: Jean-Jacques Duruz, Geneva (CH); Vittorio de Nora, Nassau (BS); Georges Berclaz, Veyras/Sierre (CH)

(73) Assignee: Moltech Invent S.A., Luxembourg (LU)

( * ) Notice: Subject to any disclaimer, the term of this patent is extended or adjusted under 35 U.S.C. 154(b) by 0 days.

(21) Appl. No.: 09/431,023

(22) Filed: Nov. 1, 1999

Related U.S. Application Data

(63) Continuation of application No. PCT/IB98/00779, filed on May 19, 1998.

(51) Int. Cl.[7] ..... C25C 3/08; C25C 3/00

(52) U.S. Cl. ..... 205/379; 205/381; 205/396; 204/245; 204/247.3; 204/247.4

(58) Field of Search ..... 205/381, 247.3, 205/372, 375, 379, 396; 204/245, 247.4, 247.5

(56) References Cited

U.S. PATENT DOCUMENTS

| | | | | |
|---|---|---|---|---|
| 3,400,061 | * | 9/1968 | Lewis et al. | 205/375 |
| 3,492,208 | * | 1/1970 | Seager | 204/245 X |
| 4,592,820 | * | 6/1986 | McGeer | 204/247.4 X |
| 4,602,990 | * | 7/1986 | Boxall et al. | 204/245 X |
| 5,560,809 | * | 10/1996 | Cortellini | 204/247.4 X |
| 5,667,664 | * | 9/1997 | Juric et al. | 205/372 X |

* cited by examiner

*Primary Examiner*—Donald R. Valentine
(74) *Attorney, Agent, or Firm*—Jayadeep R. Deshmukh

(57) ABSTRACT

A drained cathode cell for the electrowinning of aluminium comprises a cell bottom (20) arranged to collect product aluminium and thermic insulating sidewalls (40) lined with a molten electrolyte resistant sidewall lining (50), in particular containing silicon carbide, silicon nitride or boron nitride. The thermic insulating sidewalls (40) inhibit formation of an electrolyte crust on the lining (50), whereby the lining (50) is exposed to molten electrolyte. The cell bottom (20) has a peripheral zone from which the insulating sidewalls (40) extend generally vertically to form, with the cell bottom, a trough for containing molten electrolyte and aluminium produced on at least one drained cathode (32). The peripheral zone of the cell bottom (20) is arranged to keep the product aluminium from contacting and reacting with the molten electrolyte resistant sidewall lining 50).

33 Claims, 5 Drawing Sheets

ALUMINIUM ELECTROWINNING CELL WITH SIDEWALLS RESISTANT TO MOLTEN ELECTROLYTE

This application is a continuation of PCT/IB98/00779 filed May 19, 1998.

FIELD OF THE INVENTION

The invention relates to drained-cathode cells for the electrowinning of aluminium by the electrolysis of alumina dissolved in a molten fluoride-containing electrolyte having sidewalls resistant to molten electrolyte, and methods of operating the cells to produce aluminium.

BACKGROUND OF THE INVENTION

The technology for the production of aluminium by the electrolysis of alumina, dissolved in molten cryolite containing salts, at temperatures around 950° C. is more than one hundred years old.

This process, conceived almost simultaneously by Hall and Héroult, has not evolved as much as other electrochemical processes, despite the tremendous growth in the total production of aluminium that in fifty years has increased almost one hundred fold. The process and the cell design have not undergone any great change or improvement and carbonaceous materials are still used as electrodes and cell linings.

The electrolytic cell trough is typically made of a steel shell provided with an insulating lining of refractory material covered by prebaked anthracite-graphite or all graphite carbon blocks at the cell floor bottom which acts as cathode. The side walls are also covered with prebaked anthracite-graphite carbon plates.

To increase the efficiency of aluminium production numerous drained-cathode cell designs have been developed, in particular including sloping drained cathode surface, as for instance disclosed in United States Patents 3,400,061 (Lewis/Altos/Hildebrandt), 4,602,990 (Boxall/Gamson/Green/Stephen), 5,368,702 (de Nora), 5,683,559 (de Nora), European Patent Application No. 0 393 816 (Stedman), and PCT application WO99/02764 (de Nora/Duruz). These cell designs permit reduction of the inter-electrode gap and consequently reduction of the voltage drop between the anodes and cathodes. However, drained cathode cells have not as yet found significant acceptance in industrial aluminium production.

It has been proposed to decrease energy losses during aluminium production by increasing the thermal insulation of the sidewalls of aluminium production cells. However, suppression of the thermal gradient through the sidewalls prevents bath from freezing on the sidewalls and consequently leads to exposure of the sidewalls to highly aggressive molten electrolyte and molten aluminium.

Several proposals have been made in order to increase the sidewall resistance for ledgeless cell operation. U.S. Pat. No. 2,915,442 (Lewis) discloses inter-alia use of silicon carbide or silicon nitride as sidewall material. U.S. Pat. No. 3,256,173 (Schmitt/Wittner) describes a sidewall lining made of a honeycomb matrix of coke and pitch in which particulate silicon carbide is embedded. U.S. Pat. No. 5,876,584 (Cortellini) discloses sidewall lining material of silicon carbide, silicon nitride or boron carbide having a density of at least 95% and no apparent porosity.

Sidewalls of known ledgeless cells are most exposed to erosion at the interface between the molten electrolyte and the molten aluminium which accumulates on the bottom of the cell. Despite formation of an inert film of aluminium oxide around the molten aluminium metal, cryolite operates as a catalyst which dissolves the protective aluminium oxide film at the aluminium/cryolite interface, allowing the molten aluminium metal to wet the sidewalls along the molten aluminium level. As opposed to aluminium oxide, the oxide-free aluminium metal is reactive at the cell operating temperature and combines with constituents of the sidewalls, which leads to rapid erosion of the sidewalls about the molten aluminium level.

While the foregoing references indicate continued efforts to improve the operation of molten cell electrolysis operations, none suggest the invention and there have been no acceptable proposals for avoiding cell sidewall erosion caused by reaction with molten aluminium metal.

OBJECTS OF THE INVENTION

An object of the invention is to provide a design for an aluminium electrowinning cell in which electrolyte is inhibited from freezing on the sidewalls.

Another object of the invention is to provide a cell configuration for crustless or substantially crustless molten electrolyte resistant sidewalls, in particular carbide and/or nitride-containing sidewalls, which leads to an increased sidewall lifetime.

A further object of the invention is to provide a cell configuration for crustless or substantially crustless molten electrolyte resistant sidewalls, in particular carbide and/or nitride-containing sidewalls, which leads to a reduced erosion, oxidation or corrosion of the sidewalls.

A major object of the invention is to provide a drained cathode cell configuration with sidewalls resistant to molten electrolyte, in particular carbide and/or nitride-containing sidewalls, for crustless or substantially crustless operation.

SUMMARY OF THE INVENTION

One main aspect of the invention concerns a drained-cathode cell for the electrowinning of aluminium by the electrolysis of alumina dissolved in a fluoride-containing molten electrolyte. The drained-cathode cell has a cell bottom which comprises an arrangement for collecting product aluminium surrounded by a peripheral zone of the cell bottom.

Aluminium is produced on at least one drained cathode surface from which the produced aluminium drains into said arrangement for collecting the product aluminium during operation.

The drained-cathode cell further comprises one or more thermic insulating sidewalls extending generally vertically from the peripheral zone of the cell bottom to form with the cell bottom a trough for containing during operation molten electrolyte and the product aluminium. The or each thermic insulating sidewall is lined with a sidewall lining resistant to molten electrolyte, the or each thermic insulating sidewall inhibiting formation of an electrolyte crust or ledge on the sidewall lining which during operation remains permanently exposed to molten electrolyte.

The peripheral zone of the cell bottom is arranged to keep molten aluminium away from the sidewall lining, whereby the molten aluminium is prevented from reacting with the sidewall lining. The drained-cathode cell design according to the invention thus keeps the molten aluminium away from all cell sidewalls prevention it from contacting and reacting with the sidewall lining resistant to molten electrolyte, enabling use of a sidewall lining made of a carbide and/or a nitride, such as silicon carbide, silicon nitride or boron nitride, without risk of damage to the sidewall lining by reaction with molten aluminium as could occur in known designs.

The sidewall lining can be made of tiles containing carbide and/or nitride and/or can comprise a carbide and/or nitride based coating which during cell operation is in contact with the product aluminium.

Alternatively, the sidewall lining may be coated and/or impregnated with one or more phosphates of aluminium, as disclosed in U.S. Pat. No. 5,534,130 (Sekhar). The phosphates of aluminium may be selected from: monoaluminium phosphate, aluminium phosphate, aluminium polyphosphate, and aluminium metaphosphate.

Usually, the drained surface(s) is/are on one or more cathodes which are part of the cell bottom and so arranged that molten aluminium produced thereon drains away from the sidewall lining into the arrangement for collecting molten aluminium. Alternatively, the drained cathode surface(s) can be on one or more cathodes located above the cell bottom, the molten aluminium draining from the cathodes onto the cell bottom and then into the arrangement for collecting molten aluminium.

The cathode and/or the cell bottom can be made of carbonaceous material, such as compacted powdered carbon, a carbon-based paste for example as described in U.S. Pat. No. 5,362,366 (de Nora/Sekhar), prebaked carbon blocks, or graphite blocks, plates or tiles.

It is also possible for the cathode to be made mainly of an electrically-conductive non-carbon material, or of a composite material made of an electrically-conductive material and an electrically non-conductive material.

In such a composite material, the non-conductive material can be alumina, cryolite, or other refractory oxides, nitrides, carbides or combinations thereof and the conductive material can be at least one metal from Groups IIA, IIB, IIA, IIIB, IVB, VB and the Lanthanide series of the Periodic Table, in particular aluminium, titanium, zinc, magnesium, niobium, yttrium or cerium, and alloys and intermetallic compounds thereof.

The composite material's metal preferably has a melting point above the operating temperature of the electrolyte which may range from 650° C. to 970° C.

The composite material is advantageously made of alumina and aluminium or an aluminium alloy, see U.S. Pat. No. 4,650,552 (de Nora et al), or alumina, titanium diboride and aluminium or an aluminium alloy.

The composite material can also be obtained by micropyretic reaction such as that utilising, as reactants, $TiO_2$, $B_2O_3$ and Al.

The cathode may be made of a combination of at least two materials from : at least one carbonaceous material as mentioned above; at least one electrically conductive non-carbon material; and at least one composite material of an electrically conductive material and an electrically non-conductive material, as mentioned above.

The cathode and the cell bottom should be impervious and resistant or substantially impervious and resistant to molten aluminium and to the molten electrolyte, and can be rendered aluminium-impervious by one or more layers of fibres and/or by layers of a composite material as discussed above.

The cathode can comprise active cathode material and reinforcing material, one example being carbon fibres impregnated with a slurry of titanium diboride, possibly further impregnated with aluminium. It can also comprise layers of imbricated tiles or slabs of carbon, an electrically conductive material, or a composite material made of electrically conducting material and electrically non-conducting material. Advantageously a cloth of aluminium impervious material is placed between some or all of the layers of tiles or slabs.

The cathode and the cell bottom most preferably has/have an upper surface which is aluminium-wettable, for example the upper surface of the cathode or the cell bottom is coated with a coating of refractory aluminium wettable material as described in U.S. Pat. No. 5,651,874 (de Nora/Sekhar). The aluminium-wettable surface usually comprises a refractory boride, in particular $TiB_2$, advantageously applied as a coating from a slurry of particles of the refractory boride or other aluminium-wettable material.

This aluminium-wettable surface can be obtained by applying a top layer of refractory aluminium-wettable material over the upper surface (which can already have a precoating of the refractory aluminium wettable material) and over parts of the cell surrounding the cathode.

The upper surface of the cell bottom for example comprises opposed sloping surfaces leading down into a central channel for the continuous removal of product aluminium. This central draining channel (or a side channel or several channels in other embodiments) leads into an aluminium storage sump or space which is internal or external to the cell and from which the aluminium can be tapped from time to time.

Alternatively, the upper surface of the cell bottom comprises a series of oppositely sloping surfaces forming therebetween recesses or channels of various shapes, for example generally V-shaped.

In one embodiment in which the cathode is part of the cell bottom, the electric current to the cathode, in particular a cathode mass, may arrive through an inner cathode holder shell or plate (hereinafter sometimes referred to simply as "inner shell") placed between the cathode and the outer shell, usually made of steel.

In this cell, an inner cathode holder shell (or plate) of metal or suitable electrically conductive material is placed between the cathode surface and the outer shell, the inner shell serving to distribute current uniformly to the cathode or a plurality of cathodes and being connected directly to the negative busbar.

More precisely, in this embodiment, in which an electrically-conductive inner cathode holder shell or plate, electrically connected to the negative busbar, is located inside the outer shell of the cell, the inner shell containing and/or supporting the cathode and being separated from the outer shell by an electric and thermic insulating mass, the inner shell also serving to distribute current to the cathode.

In other terms, an outer mechanical structure forming an outer shell houses therein an inner electrically-conductive shell (or plate) which contains and/or supports the cathode and is connected electrically to the busbar, the inner cathode holder shell being separated from the outer shell by an electric and thermic insulation, the inner cathode holder shell also serving to distribute current to the cathode.

This cathode holder is connected by collector bars to the outside of the outer shell, whereby the cathode holder maintains the collector bars at practically constant electrical potential leading to a constant current distribution in the collector bars and a uniform distribution of electric current in the cathode. This furthermore eliminates current fluctuations due to poor distribution and flow of current typical in conventional cells, thereby reducing or eliminating the resulting non-uniform electromagnetic field that can create movement in the molten aluminium.

The cathode and its holder shell (or plate) are separated from the outer shell of the cell by insulating and refractory materials such as the usual types of insulating bricks used for cell linings. It is also possible to provide an air or gas space between the inner shell and the insulating and refractory materials. This space can be used to control the temperature of the inner shell by supplying heating or cooling gas, notably hot gas to heat the inner shell and cathode mass during cell start up.

The upper surface of the inner shell in contact with the cathode can be coated with a coating of refractory aluminium-wettable material or other protective materials as described above.

The cathode current collector bars can either extend down through the bottom of the cell or extend out through the sides of the cell. In the former case, each cathode comprises a plurality of cathode current connector bars extending down through the bottom of the cell, the current connector bars being spaced apart along the centre line of the cathode or being symmetrically distributed.

The cathode holder shell (or plate) is preferably made of metal or other suitable highly electrically conductive material. Conveniently, the cathode holder shell is made of metal and comprises a substantially flat bottom with upwardly-protruding side edges approximately at right angles to the substantially flat bottom or angled out relative to the substantially flat bottom. These upwardly-protruding edges can have outwardly projecting flanges that rest on shoulders of the cell side wall. Such flanges can also be arranged to assist lifting of the entire cathode by a crane if desired for refurbishing.

The cathode holder shell's upwardly-protruding edges can extend all around the periphery of the shell, but in some embodiments can extend only partly around the periphery, for example along two opposite sides. In the case where a supporting plate is used, there are no upwardly protruding edges.

The cathode holder shell (or plate) is usually made of a sheet of imperforate metal but can also be made of a sheet of perforated metal or of a series of metal members assembled together with or without spacings between them, the arrangement being such that this shell fulfils its function of supporting the cathode mass and uniformly distributing current to the cathode mass.

It can also be made of a series of containers each having one or more electrical feeders.

Each cell can comprise a single cathode made up of a cathode supported on its holder shell provided with current collector bars. In this case, the single cathode fits as a unit in a corresponding central recess in the cell, and the drained cathode surface co-operates with a series of anodes. For example, the cathode has a series of sloping drained cathode surfaces facing corresponding sloping anode surfaces.

Alternatively, a cell design is contemplated where the cell bottom has several recesses receiving a corresponding number of individual cathodes, each cathode co-operating with one anode or a series of anodes. In this case, the individual cathodes (inner cathode holder shell, cathode mass and current collector bar(s)) can each be installed and removed as a unit.

The cells according to the invention can make use of traditional consumable prebaked carbon anodes, continuously-fed Søderberg-type anodes, as well as non-consumable or substantially non-consumable anodes, such as metal anodes, for example as described in W099/36593 (Duruz/de Nora) and W099/36594 (de Nora/Duruz).

Whether consumable prebaked anodes or non-consumable anodes are used, it is advantageous to preheat each anode before it is installed in the cell during operation, in replacement of a carbon anode which has been substantially consumed, or a non-consumable anode that has become disactivated or requires servicing. By preheating the anodes, disturbances in cell operation due to local cooling are avoided as when an electrolyte crust is formed whereby part of the anode is not active until the electrolyte crust has melted.

The invention also relates to a cell trough for containing molten electrolyte and product aluminium, having a cell bottom fitted with insulating cell sidewalls which are protected with a molten electrolyte resistant lining as described above.

A further aspect of the invention relates to a method of producing aluminium using the cell as outlined above which contains alumina dissolved in a fluoride-containing molten electrolyte. The method involves electrolysing the dissolved alumina to produce aluminium on the or each drained cathode surface and draining the produced aluminium from the or each drained cathode surface into the arrangement for collecting the product aluminium, the produced aluminium being kept from contacting and reacting with the sidewall lining.

Advantageously, the surface of the cell bottom is maintained at a temperature corresponding to a paste state of the electrolyte whereby the cell bottom is protected from chemical attack. For example, when the cryolite-based electrolyte is at about 950° C., the surface of the cell bottom can be cooled by about 30° C., whereby the electrolyte contacting the cathode surface forms a viscous paste which protects the cell bottom.

BRIEF DESCRIPTION OF THE DRAWINGS

The invention will be further described with reference to the accompanying schematic drawings, in which.

DETAILED DESCRIPTION

Figure 1:
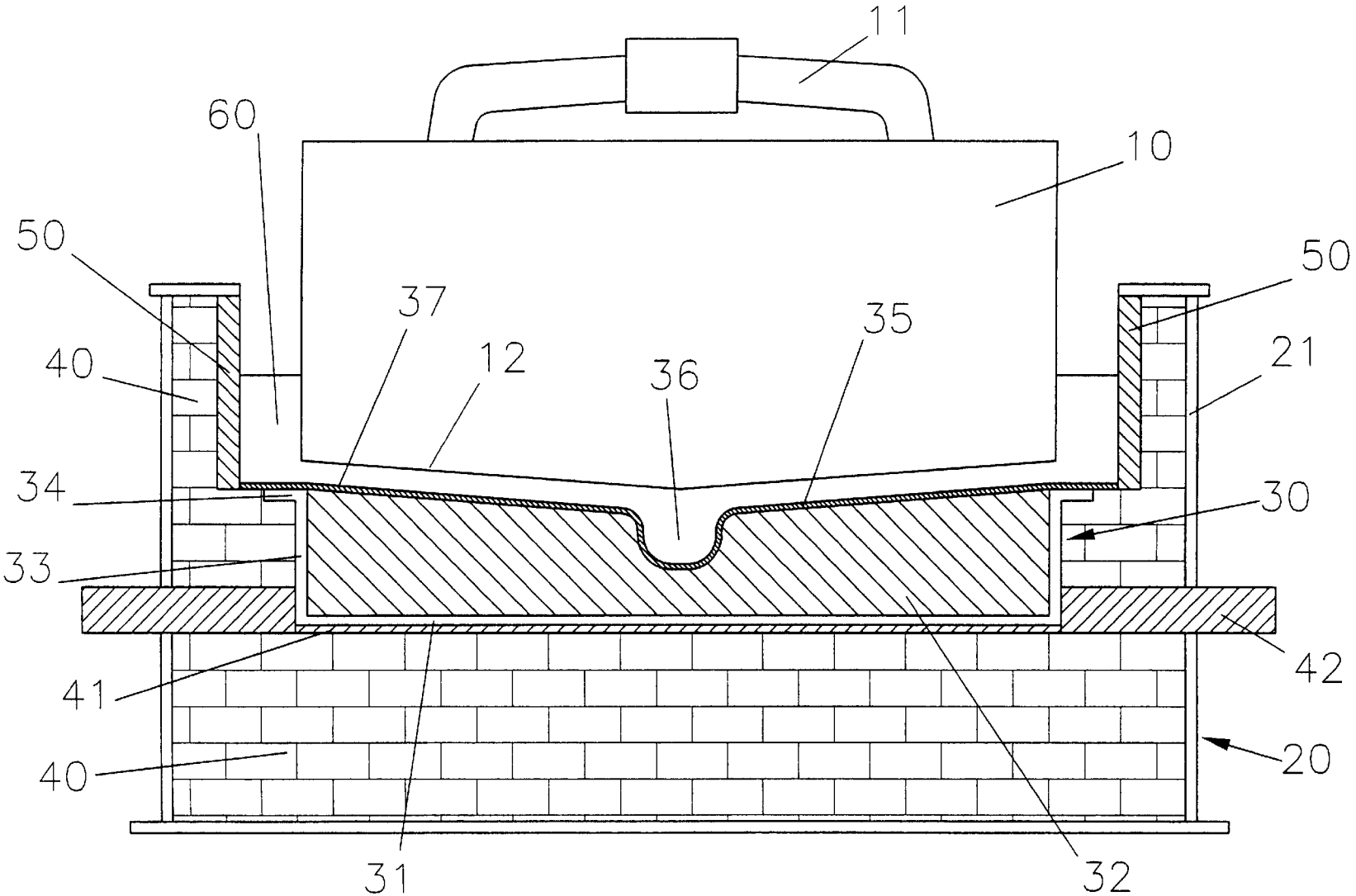
FIG. 1 is a cross-sectional view of one aluminium electrowinning cell according to the invention.

FIG. 1 schematically shows an aluminium electrowinning cell according to the invention wherein a plurality of anodes 10 are suspended by yokes 11 connected to an anode suspension and current supply superstructure (not shown) which hold the anodes 10 suspended above a cathode cell bottom 20 enclosed in an outer steel shell 21 forming, with its insulating lining of refractory bricks 40, a cell trough or cathode pot.

Inside the outer steel shell 21 is housed a cathode 30 comprising an inner steel cathode holder shell 31 containing a cathode mass 32. As illustrated, the inner shell 31 has a flat bottom, side walls 33 and outwardly-directed side flanges 34 at its top. The inner shell 31 forms an open-topped container for the cathode mass 32.

The top of the cathode mass 32 has inclined surfaces 35 leading down into a central channel 36 for draining molten aluminium. On top of the cathode mass 32, and also extending over the flanges 34, is a coating 37 of aluminium-wettable material, preferably a slurry-applied boride coating as described in U.S. Pat. No. 5,651,874 (de Nora/Sekhar). Such coating 37 can also be applied to the inside surfaces of the bottom and sides 33 of the cathode holder shell 31, to improve electrical connection between the inner shell 31 and the cathode mass 32.

The periphery of the cathode mass 32 extends to the top of the sidewall lining 33, from where it slopes down to the central channel 36.

Inside the part of the cell side walls at the top of the outer shell 21 facing the sides of anodes 10 is a sidewall lining 50 formed for example of plates of silicon carbide.

Figure 2:
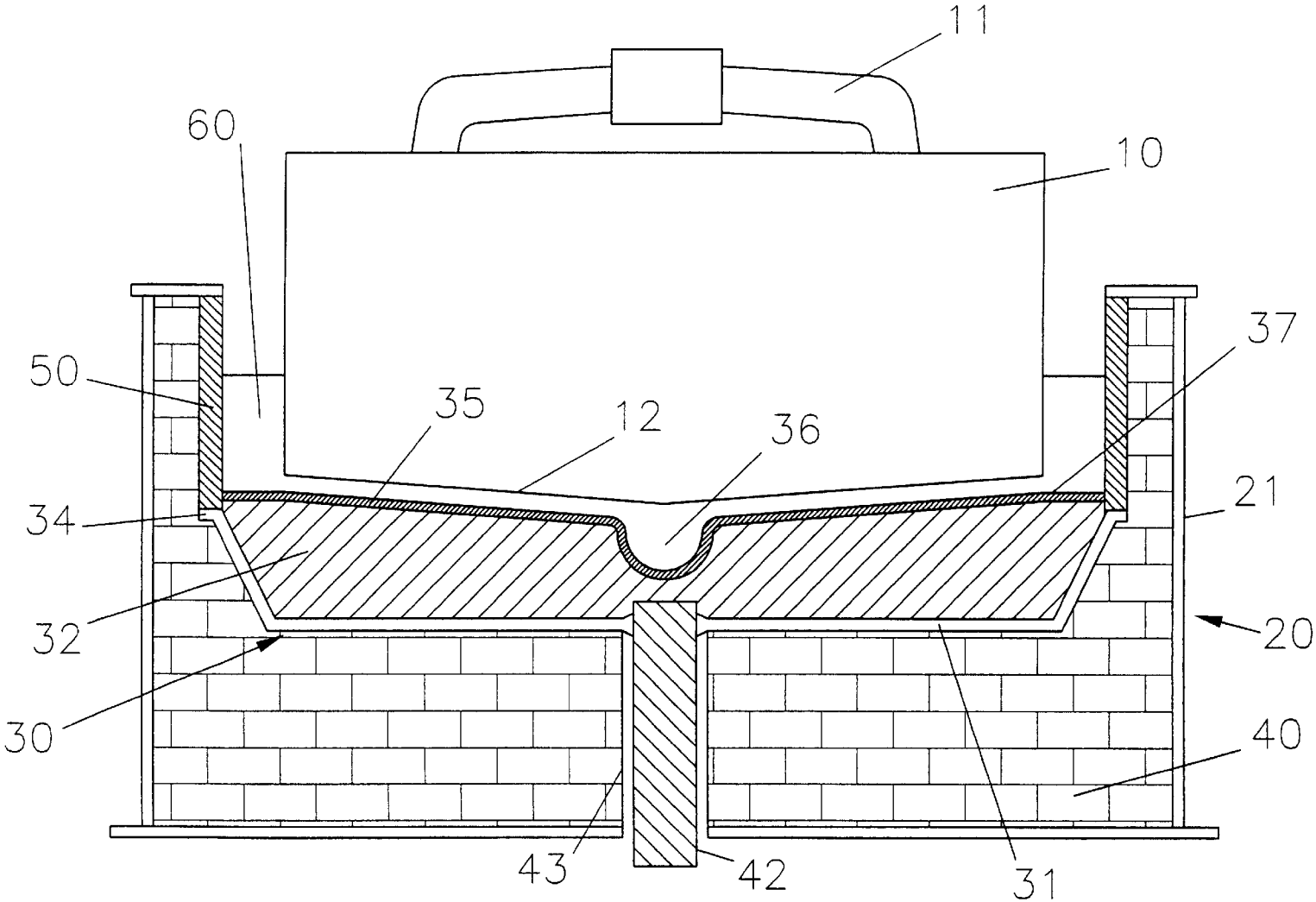
FIG. 2 is a cross-sectional view of another aluminium electrowinning cell according to the invention.
Figure 3:
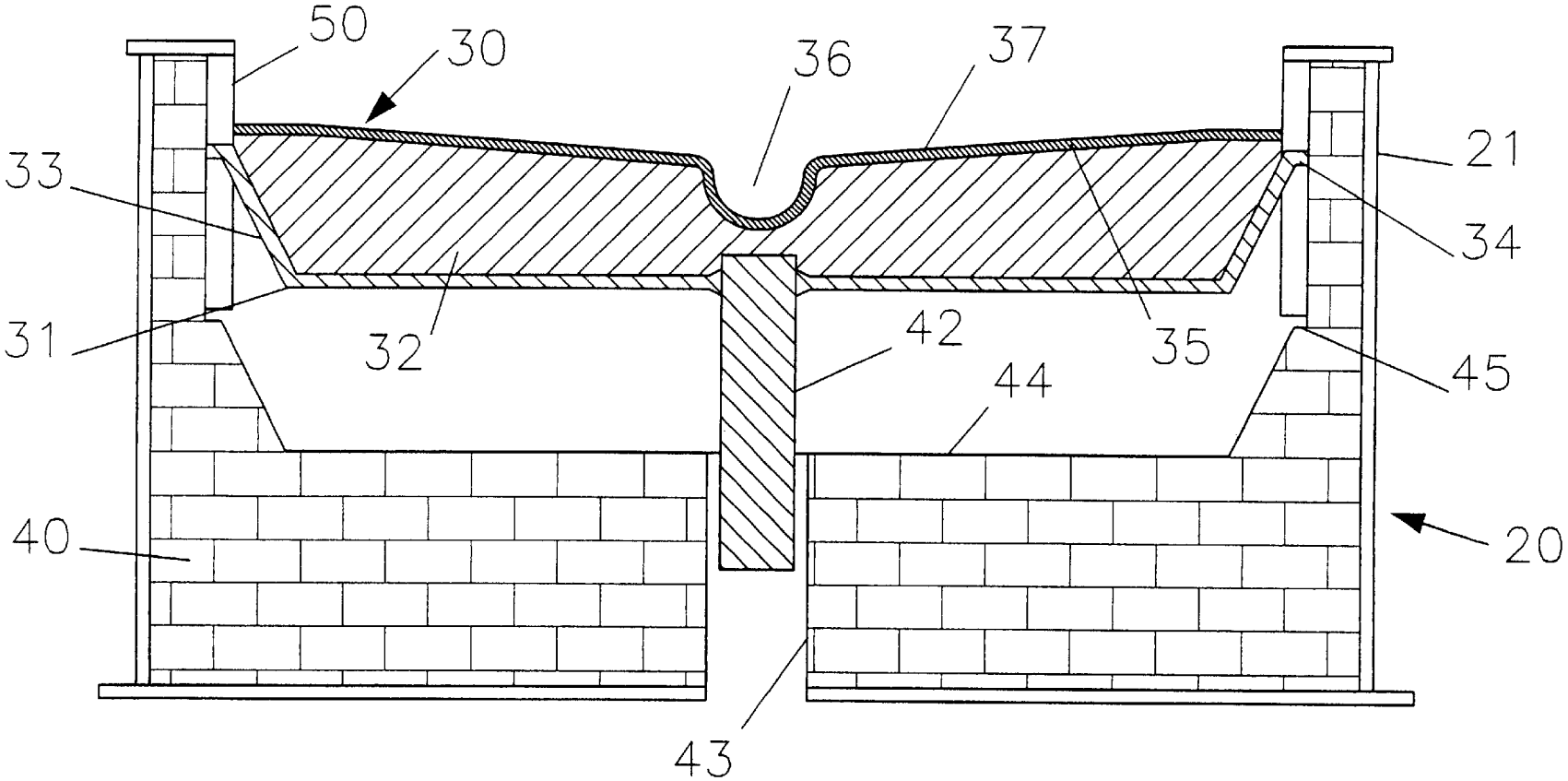
FIG. 3 shows the bottom part of the cell of FIG. 2 during assembly of a cathode unit.

As shown in FIGS. 1 to 3, the insulating sidewalls 40 extend generally vertically from a peripheral zone of the cell bottom 20. The insulating sidewalls 40 inhibit during operation formation of an electrolyte crust on the sidewall lining 50, whereby the lining is exposed to molten electrolyte 60.

According to the invention, the peripheral zone from which the insulating sidewalls 40 extend is arranged to drain molten aluminium away from the sidewall lining 50, to keep the product aluminium from contacting and reacting with the sidewall lining 50. Furthermore, where the cathode mass 32 reaches the end side walls of the cell (not shown) the sloping cathode surfaces 35 form a small wedge sloping down from the end side walls and extending across the cathode mass 32, so that the entire periphery of the sloped cathode surfaces 35 slopes away from all cell side walls to drain molten aluminium away from the sidewall lining 50.

The cathode 30 is supported as a removable unit in the cell bottom 20 in a central recess of corresponding shape in the refractory bricks 40 lining the outer steel shell 21. These refractory bricks 40 are the usual types used for lining conventional cells.

Current is supplied to the cathode 30 via transverse conductor bars 41 welded to the bottom of the inner shell 31. These conductor bars 41 are connected to current collector bars 42 which protrude laterally from the sides of the outer shell 21, these collector bars 42 being connected to external buswork (not shown).

Alternatively, current could be supplied to the cathode 30 of FIG. 1, by a series of vertical current collector bars 41 extending down through vertical openings in the bottom of the lining formed by the refractory bricks 40 (see FIG. 2).

Due to the metallic conductivity of the cathode holder shell 31, these conductor bars 41 are all maintained at practically the same electrical potential leading to uniform current distribution in the collector bars 42. Moreover, the metal inner shell 31 evenly distributes the electric current in the cathode mass 32.

In use, the space between the cathode 30 and the sidewall lining 50 is filled with a molten electrolyte 60 such as cryolite containing dissolved alumina at a temperature usually about 950–970° C., and into which the anodes 10 dip. When electrolysis current is passed, aluminium is formed on the sloping cathode surfaces 35 coated with the refractory boride coating 37, and the produced aluminium continuously drains down the sloping surfaces 35 into the central channel 36 from where it is removed permanently into an internal or external storage located usually at one end of the cell.

The anodes 10, which are shown as being consumable prebaked carbon anodes, have sloping surfaces 12 facing the sloping cathode surfaces 35. The inclination of these anode surfaces 12 facilitates the release of bubbles of the anodically-released gases. As the anode 10 is consumed, it maintains its shape, keeping a uniform anode-cathode spacing. Alternatively, it would be possible for the same cell bottom 20 and its cathode to be used with non-consumable or substantially non-consumable anodes.

Periodically, when the cathode 30 needs servicing, it is possible to close down the cell, remove the molten cell contents, and disassemble the entire cathode 30 to replace it with a new or a serviced cathode 30. This operation is much more convenient and less labour intensive than the conventional cell bottom relining process, has reduced risks relating to exposure to the toxic waste materials, and simplifies disposal of the toxic waste materials.

Figure 4:
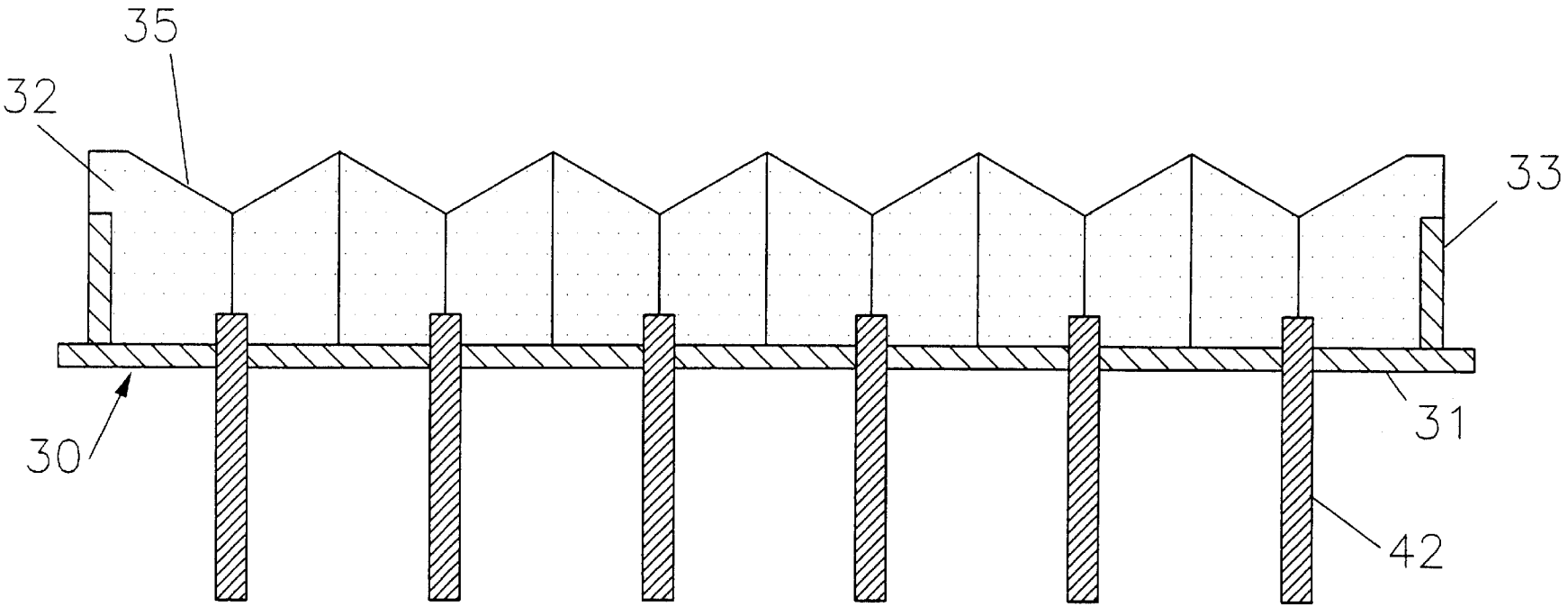
FIG. 4 shows in longitudinal cross-section an embodiment of the cathode ready to be installed in a cell.

The aluminium electrowinning cell shown in FIG. 2 is similar to that of FIG. 1 and like references have been used to designate like parts. In this design, the current collector bars 42 instead of being horizontal are vertical and extend through vertical apertures 43 in the lining of bricks 40. These collector bars 42 are welded centrally to the bottom of the inner shell 31. As illustrated in FIG. 4, several collector bars 42 are spaced apart from one another along the bottom of the inner shell 31. These collector bars 42 can have any desired cross-sectional shape : circular, rectangular, T-shaped, etc. Because the inner metal shell 31 keeps the collector bars 42 at practically the same potential, fluctuations in the current supply are avoided.

The assembly method is illustrated in FIG. 3. It is possible to install the entire cathode 30 by lowering it using a crane until the bottom of the cathode holder shell 31 comes to rest on the top 44 of the lining of bricks 40 and its side flanges 34 come to rest on shoulders 45 of the cell lining. Then, the plates 50 of silicon carbide can be installed on top of the flanges 34. This assembly method is simple and labour saving, compared to the usual cell lining methods used heretofore.

To dismantle the cell, the sidewall lining plates 50 are removed first, then the cathode 30, after disconnecting the collector bars 42 from the negative busbar. This dismantling of the cell is remarkably simple to carry out and considerably simplifies disposal of toxic wastes.

FIG. 4 shows the cathode 30 ready to be installed as a unit in an aluminium electrowinning cell (not shown) which is fitted with insulating sidewalls protected with a carbide and/or nitride containing lining according to the invention. This cathode 30 comprises a metal cathode holder shell 31 made of a flat base plate to which side walls 33 are welded substantially at right angles along its side edges. These side walls 33 can extend around the entire periphery of the base plate, or only along its opposite side edges.

To the bottom of the shell 31's base plate, a series of conductor bars 42 are welded, spaced equally apart from one another along the length of the shell 31. These conductor bars 42 protrude vertically down from the shell 31, so they can pass through corresponding vertical openings in the cell bottom, for connection to an external negative busbar.

In the shell 31 is a cathode mass 32 formed of a series of blocks, for example of carbon. As shown, the cathode blocks have sloping upper surfaces 35 and are fitted together to form a series of generally V-shaped recesses. In this example, parts of the cathode blocks protrude above the top of the side walls 33 which are embedded in the sides of the end blocks.

The upper surface 35 is made up of a series of sloping surfaces in generally V-configuration, formed by placing the adjacent blocks together. Each conductor bar 42 corresponds to the junction between two adjacent blocks forming the lower part of each V. As shown, the conductor bars 42 protrude through the shell 31 and extend part of the way up the blocks 42. Alternatively, the conductor bars 42 could be welded externally to the bottom of the shell 31.

Before use, the entire sloping upper surface 35 of the cathode mass 32 is coated with an aluminium-wettable coating typically formed of slurry-applied titanium diboride.

This cathode 30 can be produced as a unit and installed in an aluminium electrowinning cell (as illustrated in FIGS. 3) by lifting it with a crane, and lowering it into the cell.

Figure 5:
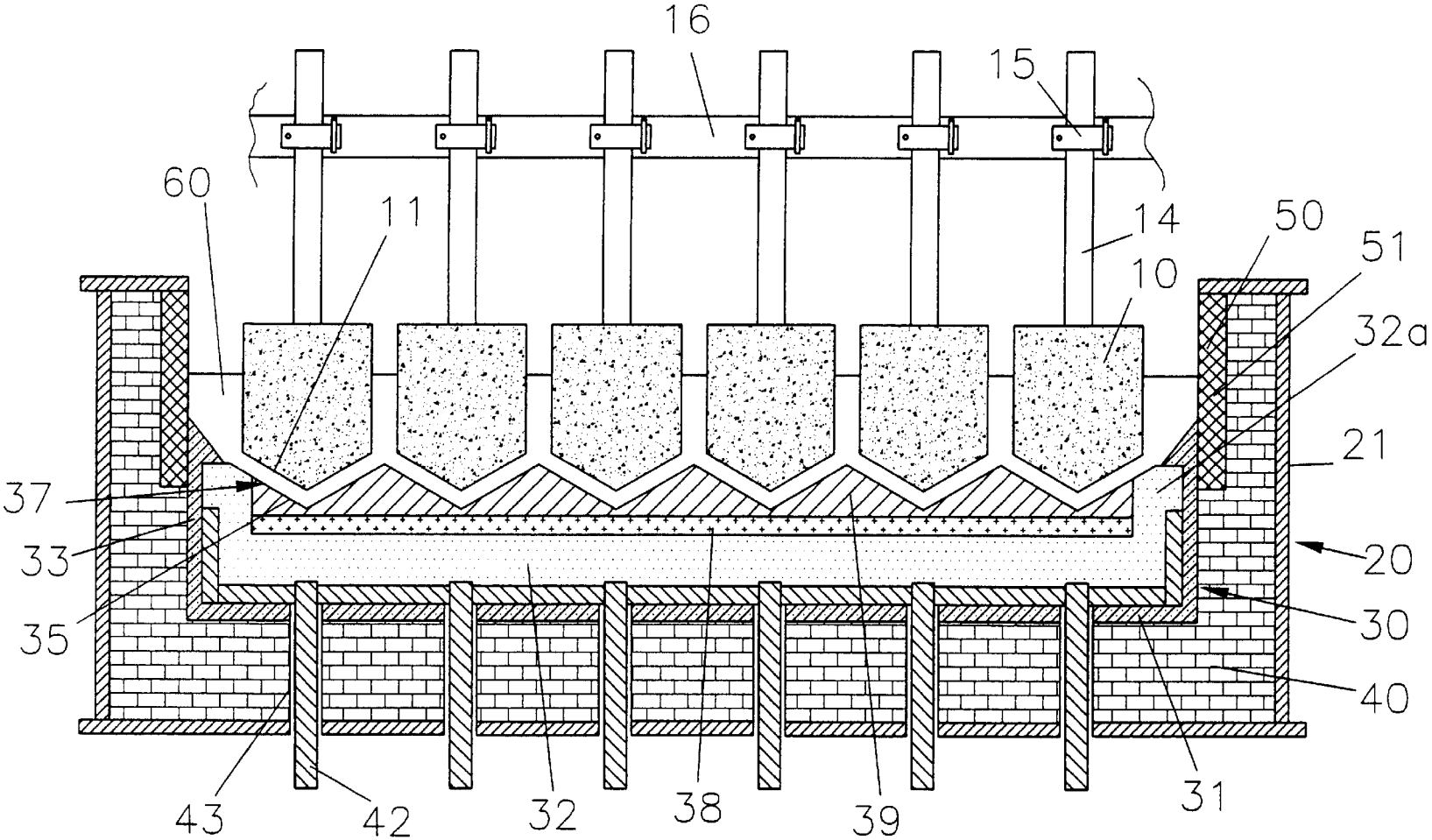
FIG. 5 is a longitudinal cross-sectional view of another aluminium electrowinning cell according to the invention.

The aluminium electrowinning cell shown in longitudinal cross-section in FIG. 5 comprises a cathode 30 with a series of spaced-apart vertical current conductors 42 welded to the bottom of its inner cathode holder shell 31, these conductors 42 protruding from the lower face of the cell bottom 20 for connection to the cathode buswork.

As in FIGS. 1 to 3, the insulating sidewalls 40 shown in FIG. 5 extend generally vertically from a peripheral zone of the cell bottom 20 which is arranged to drain molten aluminium away from the carbide and/or nitride containing sidewall lining 50, to keep the product aluminium from contacting and reacting with the sidewall lining 50.

The cathode mass 32 is made up of several layers of a conductive material such as carbon possibly combined with materials rendering the carbon impervious to molten aluminium. The mass 32 comprises an outer layer around the bottom and sides 33 of the inner shell 31. This outer layer has a peripheral edge 32*a* surrounding a central recess that is coated with a flat layer 38 of carbon or other conductive material on top of which is a toplayer 39 having sloping faces 35 coated with the layer 37 of aluminium-wettable boride. As illustrated, the upwardly-sloping side parts of the faces 35 are extended by bevelled parts of the edges 32*a* and by ramming paste 51, forming wedges along the edges of the cathode mass 32.

The sloping faces 35 of cathode mass 32 are inclined alternately to form flattened V-shaped recesses above which the anodes 10 are suspended with corresponding V-shaped inclined faces 11 of the anodes facing the V-shaped recesses in the cathode mass 32. The anodes 10 are suspended by steel rods 14 held at an adjustable height in attachments 15 by an anode bus 16, enabling the anodes 10 to be suspended with a selected anode-cathode gap.

Assembly and disassembly of the cathode 30 of this cell is similar to what has been described previously. The cathode 30 is assembled first, outside the cell, then lowered using a crane into the cell bottom 20, passing the conductor bars 42 through corresponding openings 43 in the bricks 40. Then the gaps around the edges of the cathode mass 32 are filled with ramming paste 51 which is formed into the side wedges. Next, a slurry of refractory boride is applied to the sloping cathode faces 35, usually on top of a pre-coating already applied thereto, and also over the sloping wedge surfaces of the edges 32*a* and ramming paste 51. After drying and heat treatment of the boride coating 37, the cell is ready for start-up. In operation, the central recess in the cell above the cathode mass 32 contains a molten electrolyte 60, such as cryolite containing dissolved alumina, into which the anodes 10 dip.

For disassembly to service the cell bottom 20, the molten contents are removed from the cell, and the ramming paste 51 is broken to enable the entire cathode unit 30 to be lifted out of the cell using a crane, after having disconnected the conductor bars 42 from the cathode busbar.

While the invention has been described in conjunction with specific embodiments thereof, it is evident that many modifications and variations will be apparent to those skilled in the art in the light of the foregoing description. Accordingly, it is intended to embrace all such alternatives, modifications and variations which fall within the scope of the appended claims.

What is claimed is:

1. A drained-cathode cell for the electrowinning of aluminium by the electrolysis of alumina dissolved in a fluoride-containing molten electrolyte, comprising:

a cell bottom comprising an arrangement for collecting product aluminium surrounded by a peripheral zone of the cell bottom;

one or more thermic insulating sidewalls extending generally vertically from said peripheral zone to form with the cell bottom a trough for containing during operation molten electrolyte and the product aluminium; and a sidewall lining resistant to molten electrolyte which lines the thermic insulating sidewall(s), the thermic insulating sidewall(s) inhibiting formation of an electrolyte crust or ledge on the sidewall lining which during option remains permanently exposed to molten electrolyte, said peripheral zone being arranged to keep molten aluminium away from the sidewall lining along the entire peripheral zone, whereby the molten aluminium is prevented from reacting with the sidewall lining along the entire peripheral zone.

2. The cell of claim 1, wherein the sidewall lining comprises a carbide and/or a nitride.

3. The cell of claim 2, wherein the sidewall lining comprises at least one of silicon carbide, silicon nitride and boron nitride.

4. The cell of claim 2, wherein the sidewall lining is made of carbide and/or nitride containing tiles.

5. The cell of claim 2, wherein the sidewall lining is coated with a carbide and/or nitride based coating.

6. The cell of claim 1, wherein the sidewall lining is coated and/or impregnated with one or more phosphates of aluminium.

7. The cell of claim 6, wherein said phosphates of aluminium are selected from: monoaluminium phosphate, aluminium phosphate, aluminium polyphosphate, and aluminium metaphosphate.

8. The cell of claim 1, wherein the or each drained cathode surface is on a cathode which is part of the cell bottom, the cathode being so arranged that aluminium produced thereon drains away from the sidewall lining into the arrangement for collecting product aluminium.

9. The cell of claim 8, which comprises one or more electrically-conductive inner cathode holder shells or plates supporting the cathode(s), the inner shell(s) or plate(s) being located inside an outer shell of the cell and separated from the outer shell by an electric and thermic insulating mass, the inner shell(s) or plate(s) being electrically connected to a busbar and arranged to distribute current to the cathode(s).

10. The cell of claim 9, wherein the cathode holder is a metallic shell having upwardly-protruding side edges.

11. The cell of claim 10, wherein the metallic cathode holder shell has a substantially curved bottom, V-shaped bottom or flat bottom from which the upwardly-protruding side edges are angled out, or are substantially at right angles, or are angled inwardly relative to the substantially flat bottom.

12. The cell of claim 10, wherein the side edges of the cathode holder shell have outwardly projecting flanges.

13. The cell of claim 9, wherein the cathode holder is connected to the outside of the outer shell by a plurality of current collector bars, the cathode holder maintaining the collector bars at practically the same electrical potential to provide a constant current distribution in the collector bars.

14. The cell of claim 13, wherein the cathode current collector bars extend down through the bottom of the cell.

15. The cell of claim 13, wherein the cathode current collector bars extend out through the sides of the cell.

16. The cell of claim 9, wherein an upper surface of the cathode holder in contact with the cathode is coated with a layer of refractory aluminium-wettable material.

17. The cell of claim 9, wherein the cathode holder(s) supporting the cathode(s) is/are removably mounted in the outer shell of the cell.

18. The cell of claim 17, wherein the current collector bars are fixed to the bottom of the removable cathode holder(s), the current collector bars extending down though openings in the electric and thermic insulation and through the bottom of the outer shell of the cell.

19. The cell of claim 9, wherein an air or gas space is provided between the cathode holder(s) and the electric and thermic insulating mass.

20. The cell of claim 1, wherein the or each drained cathode surface(s) is on a cathode located above the cell bottom, the cathode being so arranged that aluminium produced thereon drains away from the sidewall lining into the arrangement for collecting product aluminium.

21. The cell of claim 1, wherein the or each drained cathode surface is on a carbonaceous cathode.

22. The cell of claim 1, wherein the or each drained cathode surface is on a cathode made mainly of an electrically conductive non-carbon composite material.

23. The cell of claim 1, wherein the or each drained cathode surface is on a cathode made of a composite material made of an electrically conductive material and an electrically non-conductive material.

24. The cell of claim 1, wherein the or each drained cathode surface is on a cathode made of a combination of at least one carbonaceous material and at least one electrically conductive composite material.

25. The cell of claim 1, wherein the or each drained cathode surface is coated with a coating of refractory aluminium-wettable material.

26. The cell of claim 25, wherein the coating of refractory aluminium-wettable material comprises a refractory boride.

27. The cell of claim 26, wherein the coating of refractory aluminium-wettable material comprises titanium diboride.

28. The cell of claim 1, wherein the cell bottom comprises opposed sloping surfaces leading down into a central channel for the removal of product aluminium.

29. The cell of claim 28, wherein the cell bottom comprises a series of oppositely sloping surfaces forming therebetween a series of recesses or channels.

30. The cell of claim 29, wherein the recesses or channels formed between the oppositely sloping surfaces are generally V-shaped.

31. A trough of a drained-cathode cell for the electrowinning of aluminium by the electrolysis of alumina dissolved in a fluoride-containing molten electrolyte, comprising:

a cell bottom comprising an arrangement for collecting product aluminium surrounded by a peripheral zone of the cell bottom;

one or more thermic insulating sidewalls extending generally vertically from said peripheral zone to form with the cell bottom a trough for containing during operation molten electrolyte and the product aluminium; and a sidewall lining resistant to molten electrolyte which lines the thermic insulating sidewall(s), the thermic insulating sidewall(s) inhibiting formation of an electrolyte crust or ledge on the sidewall lining which during operation remains permanently exposed to molten electrolyte, said peripheral zone being arranged to keep molten aluminium away from the sidewall lining along the entire peripheral zone, whereby the molten aluminium is prevented from reacting with the sidewall lining along the entire peripheral zone.

32. A method of producing aluminium using a cell for the electrowinning of aluminium by the electrolysis of alumina dissolved in a fluoride-contaning molten electrolyte, the cell comprising a cell bottom comprising an arrangement for collecting product aluminium surrounded by a peripheral zone of the cell bottom; one or more thermic insulating sidewalls extending generally vertically from said peripheral zone to form with the cell bottom a trough for containing during operation molten electrolyte and the product aluminium; and a sidewall lining resistant to molten electrolyte which lines the thermic insulating sidewall(s), the thermic insulating sidewall(s) inhibiting formation of an electrolyte crust or ledge on the sidewall lining which during operation remains permanently exposed to molten electrolyte, the method comprising:

electrolysing the dissolved alumina to produce aluminium on the or each drained cathode surface into the arrangement for collecting the product aluminium, the produced aluminium being kept from contacting and reacting with the sidewall lining along the entire peripheral zone.

33. The method of claim 32, comprising maintaining the surface of the cell bottom at a temperature corresponding to a paste state of the electrolyte whereby the cell bottom is protected from chemical attack.

* * * * *